US006438486B1

(12) United States Patent
Mancini

(10) Patent No.: US 6,438,486 B1
(45) Date of Patent: Aug. 20, 2002

(54) SYSTEM AND METHOD FOR MINIMIZING FUEL EVAPORATIVE EMISSIONS FROM AN INTERNAL COMBUSTION ENGINE

(75) Inventor: Douglas Joseph Mancini, Farmington, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/666,195

(22) Filed: Sep. 21, 2000

(51) Int. Cl.[7] ..... F02D 41/06; F02M 33/02
(52) U.S. Cl. ..... 701/104; 123/491; 123/518
(58) Field of Search ..... 701/104; 123/478, 123/480, 491, 518, 519

(56) References Cited

U.S. PATENT DOCUMENTS 4,279,630 A * 7/1981 Nakamura et al. ..... 123/518
4,436,073 A * 3/1984 Miyagi ..... 123/491
4,715,340 A 12/1987 Cook et al.

* cited by examiner

*Primary Examiner*—Andrew M. Dolinar
(74) *Attorney, Agent, or Firm*—Carlos L. Hanze

(57) ABSTRACT

A method for minimizing evaporative fuel emissions of a vehicle having an internal combustion engine, the engine having a combustion chamber, a corresponding fuel injector and a throttle valve assembly in cooperation with a corresponding intake manifold, the method including the step of storing fuel vapors that emanate from the engine to prevent "upstream" migration of the fuel vapors from the engine through the throttle valve assembly. The stored fuel vapors can then be released back into the engine for combustion thereby avoiding release into the atmosphere.

6 Claims, 2 Drawing Sheets

SYSTEM AND METHOD FOR MINIMIZING FUEL EVAPORATIVE EMISSIONS FROM AN INTERNAL COMBUSTION ENGINE

FIELD OF THE INVENTION

The present invention relates generally to fuel vapor emission control in vehicles having internal combustion engines. More particularly, the invention relates to a system and method for removing hydrocarbons from the air induction system of an internal combustion engine.

BACKGROUND OF THE INVENTION

Vehicles having internal combustion engines are known to release unwanted hydrocarbons during refueling and cold starting of the vehicle engine. During refueling, for example, unburned fuel vapors containing such hydrocarbons are released from the vehicle's fuel tank after the fuel tank cap is removed. Similarly, because a stoichiometric air/fuel ratio is difficult to achieve during cold start, a higher proportion of unburned fuel vapor is delivered to the vehicle's catalytic converter thus resulting in higher concentration of hydrocarbons released into the atmosphere.

As such, vehicles have been designed to include various systems and methods for minimizing the release of fuel vapor emissions during vehicle start-up and refueling. Examples of such systems are disclosed in U.S. Pat. Nos. RE 36,737, 5,924,410 and 5,957,114, which are all assigned to the assignee of the present invention.

Such systems, for example, are not helpful for controlling the release of unburned fuel vapors from combustion chambers and/or fuel ports during engine operation. One such situation occurs after evaporative emissions migrate or "leak" back in an "upstream" direction from the combustion chambers and/or fuel ports of the engine through a corresponding intake manifold and throttle valve. Any emissions migrating back through the intake valves are then subject to release into the atmosphere.

Accordingly, and further in light of increasingly stringent environmental standards, the inventor herein has recognized the need to minimize the amount of unburned fuel vapors migrating back into the air induction system of an internal combustion engine.

SUMMARY OF THE INVENTION

The aforedescribed limitations and inadequacies of conventional fuel evaporative emission controls systems and methods are substantially overcome by the present invention, in which a method is provided for minimizing evaporative fuel emissions of a vehicle having an internal combustion engine. The method includes the step of storing fuel vapors emanating from the engine to prevent the migration of the fuel vapors in an "upstream" direction from the engine through the throttle valve assembly. Preferably, the stored fuel vapors are released back into the engine's air induction system during engine operation. During engine start-up, for example, the amount of fuel required for start-up can be adjusted in order to take into account the release of the fuel vapors into the air induction system of the engine.

An advantage of the above method is that the amount of fuel evaporative vapors accumulated in the engine's air induction system is reduced, thereby preventing the release of residual gases, e.g., hydrocarbons, into the atmosphere. By storing and then releasing the evaporative emissions at an appropriate time, such a system is especially advantageous for compliance with government fuel emissions standards. The amount of stored fuel vapor released back into the engine's air induction system can then be used to "calibrate-out" a corresponding amount of fuel required for engine operation. For example, taking into account the amount of released fuel vapors can reduce the amount of fuel required for engine start-up. Consequently, an additional advantage is realized in that less fuel is required for engine start-up.

In accordance with a related aspect of the present invention, a corresponding system for minimizing fuel evaporative emissions is provided. The system includes a duct connected to a throttle valve assembly for providing atmospheric air to the engine and a fuel vapor absorbing material disposed on the interior of the duct for absorbing and storing the fuel emissions emanating from the engine through the intake manifold and the throttle valve assembly. Preferably, the duct is includes a first end coupled to the throttle valve assembly, and a fuel vapor absorbing material disposed on the interior for absorbing and storing the fuel emissions. The system also includes an engine controller for determining an amount of fuel to be provided to the engine and adjusting an amount of fuel provided to the engine after the stored fuel emissions are released from the material.

Still further, in accordance with yet another aspect of the present invention, an article of manufacture is disclosed for operating an internal combustion engine having a throttle valve assembly in cooperation with a corresponding intake manifold and fuel vapor absorbing material near the throttle valve assembly for absorbing and storing evaporative fuel emissions emanating from the engine through the intake manifold and the throttle valve assembly. The article of manufacture includes a computer usable medium and a computer readable program code embodied in the computer usable medium for directing the computer to perform the steps of directing the computer to perform the step steps of determining an amount of fuel to be provided to the engine and adjusting an amount of fuel provided to the engine after the stored evaporative fuel emissions are released from the material.

Further objects, features and advantages of the invention will become apparent from the following detailed description taken in conjunction with the accompanying figures showing illustrative embodiments of the invention.

BRIEF DESCRIPTION OF THE DRAWINGS

For a complete understanding of the present invention and the advantages thereof, reference is now made to the following description taken in conjunction with the accompanying drawings in which like reference numbers indicate like features and wherein.

DETAILED DESCRIPTION OF THE PREFERRED EMBODIMENTS

Figure 1:
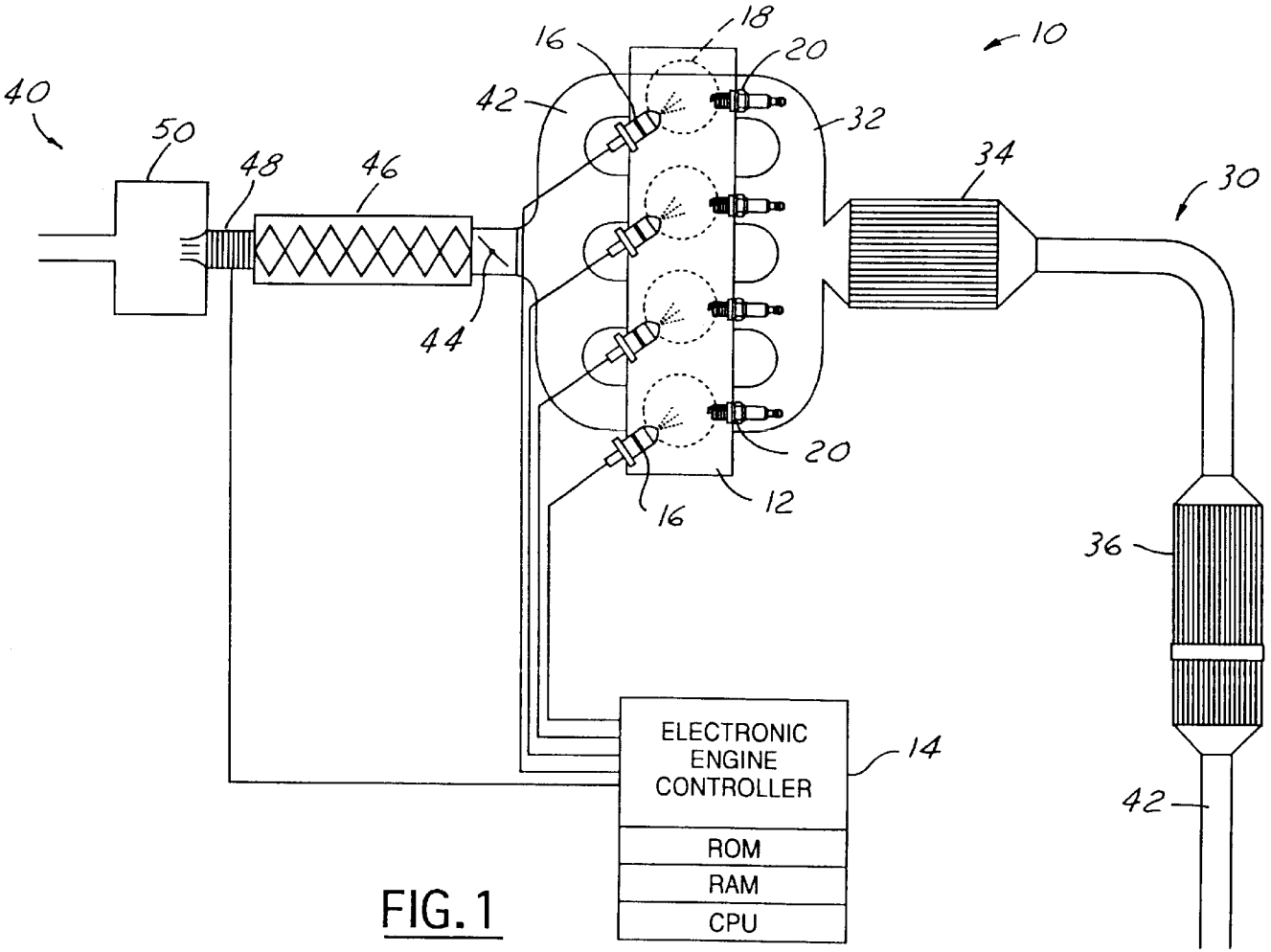
FIG. 1 is a diagram of an internal combustion engine using a system for minimizing fuel evaporative emissions in accordance with a preferred embodiment of the present invention.

FIG. 1 shows a diagram of an internal combustion engine 10 using a system for minimizing fuel evaporative emissions in accordance with the present invention. The engine 10 shown in FIG. 1, by way of example and not limitation, is a gasoline four-stroke direct fuel injection (DFI) internal combustion engine having a plurality of cylinders, each of the cylinders having a combustion chamber 18 and corresponding fuel injectors 16 and spark plugs 20. The engine 10, however, can be any internal combustion engine, such as a port fuel injection (PFI) or diesel engine, having an air induction system provided on the intake side of the engine as shown in FIG. 1. The air induction system 40 includes an intake manifold 42, a throttle valve 44 and corresponding assembly, a fuel vapor storage duct 46 and an air mass flow (MAF) sensor 48 integrated with an air cleaner assembly 50. Exhaust gases generated during combustion are provided to an exhaust system 30, which nominally includes an exhaust manifold 32, an upstream three-way catalytic converter 34, a downstream nitrogen oxide ($NO_x$) trap 36 and a tailpipe 42.

Connected to the MAF sensor is an electronic engine controller 14 having a processor (CPU) with corresponding input/output ports, read-only memory (ROM) or any suitable electronic storage medium containing processor-executable instructions and calibration values, random-access memory (RAM) and a data bus of any suitable configuration. The controller 14 receives signals from a variety of sensors coupled to the engine 10 and/or the vehicle and controls the operation of the fuel injectors 16, each of which is positioned to inject fuel into their respective cylinders 18 in precise quantities as determined by the controller 14. The controller 14 similarly controls the operation of each of the spark plugs 20 in a known manner.

The controller 14 also controls the operation of the throttle valve 44, which in turn regulates the mass flow of air into the engine 10. The air mass flow sensor 48, positioned upstream of the duct 46, provides a signal representing the air mass flow resulting from positioning of the engine's throttle 44. The air mass flow signal from the sensor 48 is utilized by the controller 14 to calculate an air mass value indicative of a mass of air flowing per unit time into the engine's induction system 40.

Figure 2:
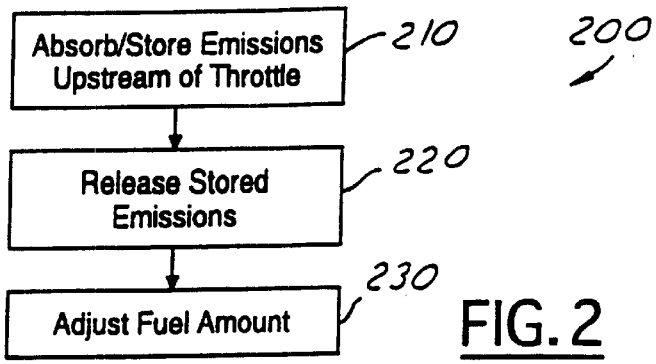
FIG. 2 is a flow diagram of a preferred method of the present invention for minimizing fuel evaporative emissions of an internal combustion engine.

FIG. 2 shows a flow diagram of a preferred method of the present invention for minimizing fuel evaporative emissions of an internal combustion engine. The method, which is directed at reducing the amount of hydrocarbon molecules migrating from the combustion chambers (or fuel ports) past the throttle valve assembly, includes the steps of absorbing, upstream of the throttle valve assembly, fuel vapors emitted from the engine through the intake manifold and throttle valve assembly, step 210, releasing the stored fuel vapors for use by the engine, step 220 and optionally adjusting or "calibrating out" an amount of fuel to be injected into the combustion chambers to take into account the released fuel vapors, step 230. The vapor absorbing step, step 210, is performed by the duct 46, which is preferably a plastic cylinder disposed between the MAF sensor 46 and the throttle valve 44. The interior of the duct 46 is lined with activated carbon particles or the like for absorbing hydrocarbon molecules or the like contained in the fuel vapor emissions.

The release or purging of the hydrocarbon molecules, step 220, is nominally performed during engine start-up or selected periods of engine operation. Preferably, the engine controller 14, which normally determines an amount of fuel to be provided to the engine, adjusts the amount based on the volume of stored fuel vapors released from the duct 46.

Figure 3:
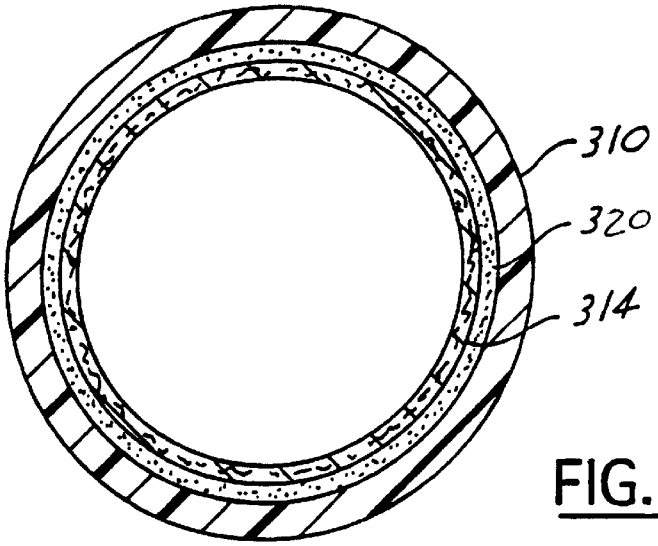
FIG. 3 is cross-sectional view of a preferred embodiment of an apparatus for minimizing fuel evaporative emissions of an internal combustion engine.
Figure 4:
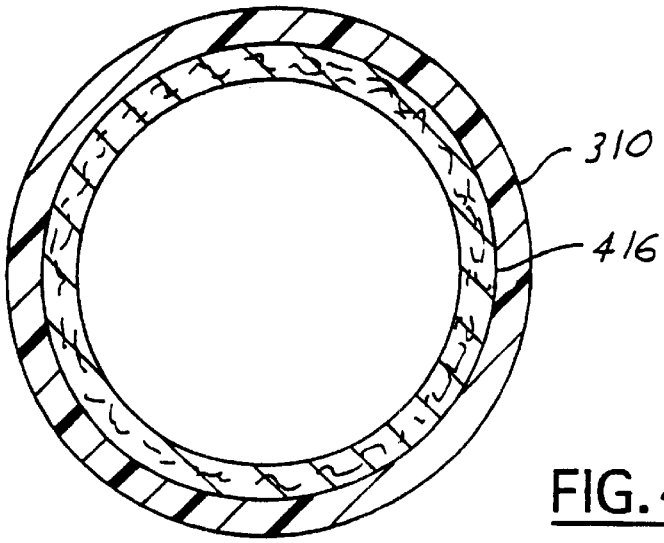
FIG. 4 is cross-sectional view of another preferred embodiment of an apparatus for minimizing fuel evaporative emissions of an internal combustion engine.

FIGS. 3 and 4 show cross-sectional views of preferred embodiments of the duct apparatus shown above in FIG. 1. In a first embodiment, as shown in FIG. 3, the duct includes a plastic tube 310, an adhesive layer 320 disposed on the interior surface of the tube 310, and a coating of activated carbon particles 314 disposed on the adhesive layer 320. Preferably, the coating 314 is applied using a suitable spray deposition technique. Alternatively, as shown in FIG. 4, a layer 416 of activated carbon particles combined with a gas-permeable polymer such as polyethylene is disposed along the interior of the plastic duct 310 to provided improved absorption of hydrocarbon molecules.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A method for minimizing evaporative fuel emissions of a vehicle having an internal combustion engine, the engine having a combustion chamber, a corresponding fuel injector and a throttle valve assembly in cooperation with a corresponding intake manifold, the method comprising:

storing fuel vapors emanating from the engine to prevent migration thereof from the engine through the throttle valve assembly and the intake manifold;

releasing the stored fuel vapors into the engine upon engine start-up; and adjusting an amount of fuel provided to the engine at engine start-up based on a volume of the stored fuel vapors released at engine start-up.

2. A system for minimizing evaporative fuel emissions of a vehicle having an internal combustion engine, the engine having a combustion chamber, a corresponding fuel injector and a throttle valve assembly in cooperation with a corresponding intake manifold, said system comprising:

a duct connected to the throttle valve assembly for providing atmospheric air to the engine;

a fuel vapor absorbing material disposed on the interior of the duct for absorbing and storing-fuel vapors emitted from the engine through the throttle valve assembly; and an engine controller coupled to the fuel injector for adjusting an amount of fuel to be provided to the engine at engine start-up based on a volume of stored fuel vapors released from said fuel vapor absorbing material at engine start-up.

3. An apparatus coupled to the air induction system of an internal combustion engine, the air induction system having an intake manifold and a throttle valve assembly, the apparatus comprising:

a duct having a first end coupled to the throttle valve assembly, said duct comprising a plastic tube;

a fuel vapor absorbing material disposed on the interior of said plastic tube for absorbing and storing the evaporative fuel emissions, said fuel vapor absorbing material comprising a layer of activated carbon particles; and an adhesive layer disposed between the interior of said plastic tube and said activated carbon layer.

4. An apparatus coupled to the air induction system of an internal combustion engine, the air induction system having an intake manifold and a throttle valve assembly, the apparatus comprising:

a duct having a first end coupled to the throttle valve assembly, said duct comprising a plastic tube; and a fuel vapor absorbing material disposed on the interior of said plastic tube for absorbing and storing the evaporative fuel emissions, said fuel vapor absorbing material comprising a layer of activated carbon particles mixed with a gaspermeable polymer.

5. The apparatus according to claim 4, wherein said gas-permeable polymer is polyethylene.

6. An article of manufacture for operating an internal combustion engine having a throttle valve assembly in cooperation with a corresponding intake manifold and fuel vapor absorbing material near the throttle valve assembly for absorbing and storing evaporative fuel emissions emanating from the engine and through the throttle valve assembly, comprising:

a computer usable medium; and a computer readable program code embodied in the computer usable medium for directing the computer to perform the step of adjusting an amount of fuel to be provided to the engine at engine start-up based on a volume of the stored evaporative fuel emissions released from the material.

* * * * *